US007553768B2

(12) United States Patent
Nakamura et al.

(10) Patent No.: US 7,553,768 B2
(45) Date of Patent: Jun. 30, 2009

(54) SUBSTRATE AND A METHOD FOR POLISHING A SUBSTRATE

(75) Inventors: Kazuyoshi Nakamura, Sagamihara (JP); Toshihide Nakajima, Akishima (JP); Kousuke Nakajima, Sagamihara (JP); Takahisa Oonami, Machida (JP)

(73) Assignee: Ohara Inc., Sagamihara-shi (JP)

( * ) Notice: Subject to any disclaimer, the term of this patent is extended or adjusted under 35 U.S.C. 154(b) by 0 days.

(21) Appl. No.: 11/398,703

(22) Filed: Apr. 6, 2006

(65) Prior Publication Data

US 2006/0226124 A1 Oct. 12, 2006

(30) Foreign Application Priority Data

Apr. 8, 2005 (JP) ..... 2005-112070

(51) Int. Cl.
*H01L 21/302* (2006.01)

(52) U.S. Cl. ..... 438/691; 438/692; 438/693; 451/106

(58) Field of Classification Search ..... 438/691, 438/692, 693, 694; 451/413, 526, 533, 28, 451/106

See application file for complete search history.

(56) References Cited

U.S. PATENT DOCUMENTS 6,120,353 A * 9/2000 Suzuki et al. ..... 451/41
6,159,643 A 12/2000 Levinson et al.
6,905,402 B2 * 6/2005 Allison et al. ..... 451/533
2002/0077036 A1 6/2002 Roberts et al.
2003/0124862 A1 * 7/2003 Miyairi et al. ..... 438/692
2004/0166420 A1 8/2004 Aschke et al.
2004/0192175 A1 9/2004 Nakano et al.
2005/0098446 A1 * 5/2005 Tsai et al. ..... 205/672
2006/0140105 A1 * 6/2006 Minami et al. ..... 369/272.1

FOREIGN PATENT DOCUMENTS

WO WO 2004/058451 A1 7/2004

OTHER PUBLICATIONS

European Search Report dated Jul. 13, 2006, issued in corresponding European Application No. 06111884.0.
Corning's Approach to Segment Blank Manufacturing for an Extremely Large Telescope SPIE AT&I Symposium, Jun. 21-25, 2004 Glasgow, Scotland, VanBrocklin et al.
"Effects of Particle Concentration on Chemical Mechanical Planarization", Electrochemical and Solid-State Letters, 5 (12) G109-G112 (2002), Cooper et al.

* cited by examiner

*Primary Examiner*—Lan Vinh
(74) *Attorney, Agent, or Firm*—Westerman, Hattori, Daniels & Adrian, LLP.

(57) ABSTRACT

A substrate having flatness of less than 230 nmPV and surface roughness at RMS of less than 0.20 nm. is obtained by a method comprising: a process of polishing an object to be polished with a polishing pad comprising at least one layer having compressibility of 5% or below in a base layer of the polishing pad.

12 Claims, No Drawings

SUBSTRATE AND A METHOD FOR POLISHING A SUBSTRATE

FIELD OF THE INVENTION

This invention relates to a substrate having extremely accurate flatness and surface roughness and, more particularly, to a substrate suitable for use in electronic devices such as a substrate for a mask blank. The invention relates also to a method for polishing such substrate.

BACKGROUND OF THE INVENTION

In the field of semiconductors, demand for integrated circuits of a higher density is increasing for improving efficiency of handling information. For realizing such higher density integrated circuits, there has been a proposal for a technique of applying exposure wavelength of extreme ultra-violet ray (EUV) in a chip manufacturing process. A mask substrate of an exposure apparatus used in this technique is obtained by polishing an extremely low expansion material and highly accurate flatness and surface roughness are required for such mask substrate. As materials of a mask substrate and a mirror substrate for EUV micro-lithography, extremely low expansion materials such as CLEARCERAM (trademark) of Ohara Inc., Zerodur (trademark) of Schott AG, Zerodur-M (trademark) of Schott GmbH and ULE (trademark) of Corning Incorporated are suitable, for these materials have a very small thermal expansion coefficient and high homogeneity.

Japanese Patent Application Laid-open Publication No. 2004-228563 discloses a method for producing a substrate suited for EUV micro-lithography from such materials. This publication reports that, even if a substrate is polished to surface roughness of 0.1 nm to 0.3 nm at RMS (root-mean-square roughness), application of ion beam processing for achieving desired flatness causes increase in the surface roughness to twofold to five-fold the value before application of the ion beam processing. In this publication, a covering layer is formed on the base layer of the substrate for evading such increase in surface roughness. This method, however, has not realized flatness and surface roughness required for the base layer per se.

Japanese Patent Application Laid-open Publication No. 2004-29735 discloses a substrate for electronic devices and a method for polishing the substrate. The substrate obtained by this polishing method, however, does not exhibit surface property values which are better than flatness of 230 nm and surface roughness Ra of 0.18 nm. Since Ra (arithmetic mean roughness) which is a parameter indicating surface roughness is lower than a value of RMS (root-mean-square roughness), the surface roughness of Ra 0.18 nm is a value exceeding 0.20 nm when it is expressed in RMS. Further, a material for a substrate considered in this publication is glass only and no consideration is given to achievement of desired surface property values by polishing materials other than glass including glass-ceramics such as the above mentioned CLEARCERAM of Ohara, Inc.

Thus, in the high accuracy region required by EUV lithography, flatness and surface roughness are surface properties which conflict with each other and, when an attempt is made to achieve one of these surface properties, the other surface property fails to achieve a desired value. In the past, accordingly, there has not been a substrate which satisfies both flatness of less than 230 nmPV (peak-to-value) and surface roughness at RMS of less than 0.20 nm simultaneously without providing a special cover layer on the base layer of the substrate.

It is, therefore, an object of the present invention to provide substrates having excellent flatness and surface roughness in the high accuracy region, particularly substrates for liquid crystal display and electronic devices including semiconductor wafers or information recording medium and, more particularly, substrates for EVU micro-lithography, without providing a cover layer but by having such surface properties in the substrate per se.

It is also an object of the invention to provide a method for polishing such substrates.

SUMMARY OF THE INVENTION

For achieving the above described objects of the invention, studies and experiments made by the inventors of the present invention have resulted in the finding, which has led to the present invention, that a substrate having excellent flatness and surface roughness in the high accuracy region can be obtained by adopting a specific polishing process.

For achieving the objects of the invention, in the first aspect of the invention, there is provided a substrate having flatness of less than 230 nmPV and surface roughness at RMS of less than 0.20 nm.

In the second aspect of the invention, there is provided a substrate as defined in the first aspect obtained by a method comprising:

(a) a process of polishing an object to be polished with an polishing pad comprising at least one layer having compressibility of 5% or below in a base layer of the polishing pad.

In the third aspect of the invention, there is provided a substrate as defined in the first aspect obtained by a method comprising:

(a) a process of polishing an object to be polished with a polishing pad comprising at least one layer made of a resin film and having compressibility of 5% or below in a base layer of the polishing pad.

In the fourth aspect of the invention, there is provided a substrate as defined in the second or third aspect obtained by a method wherein the process (a) comprises:

(a-1) a process of polishing an object to be polished by a polisher while maintaining surface load of 40 g/cm$^2$ or below to the object to be polished and supplying a polishing medium.

In the fifth aspect of the invention, there is provided a substrate as defined in the fourth aspect obtained by a method wherein the process (a) comprises:

(a-2) a process performed subsequent to the process (a-1) of polishing the object to be polished by the polisher while supplying only liquid which does not contain a polishing medium.

In the sixth aspect of the invention, there is provided a substrate as defined in the fifth aspect obtained by a method wherein surface load to the object to be polished is maintained at 40 g/cm$^2$ or below in the process (a-2).

In the seventh aspect of the invention, there is provided a substrate as defined in any of the second to sixth aspects obtained by a method comprising:

(b) a process performed prior to the process (a) of polishing the object to be polished to flatness of at least 230 nmPV and surface roughness at RMS of at least 0.4 nm.

In the eighth aspect of the invention, there is provided a substrate as defined in any of the second to seventh aspects wherein the polishing medium used in the process (a) is a cerium oxide polishing medium.

In the ninth aspect of the invention, there is provided a substrate as defined in any of the second to eighth aspects wherein an average particle diameter of the polishing medium used in the process (a) is 1.0 μm or below.

In the tenth aspect of the invention, there is provided a substrate as defined in any of the second to ninth aspects wherein concentration of the polishing medium used in the process (a) is 1.0 wt % or below.

In the eleventh aspect of the invention, there is provided a substrate as defined in any of the first to tenth aspects wherein an average linear thermal expansion coefficient is within a range of $0.0\pm0.3\times10^{-7}$/° C. within temperature range from 0° C. to 50° C.

In the twelfth aspect of the invention, there is provided a substrate as defined in any of the first to eleventh aspects wherein an average linear thermal expansion coefficient is within a range of $0.0\pm0.3\times10^{-7}$/° C. within temperature range from 19° C. to 25° C.

In the thirteenth aspect of the invention, there is provided a substrate as defined in any of the first to twelfth aspects comprising $SiO_2$ and $TiO_2$.

In the fourteenth aspect of the invention, there is provided a substrate for a photo mask using the substrate as defined in any of the first to thirteenth aspects.

In the fifteenth aspect of the invention, there is provided a photo mask using the substrate as defined in the fourteenth aspect.

In the sixteenth aspect of the invention, there is provided a method for polishing a substrate comprising:

(a) a process of polishing an object to be polished with an polishing pad comprising at least one layer having compressibility of 5% or below in a base layer of the polishing pad.

In the seventeenth aspect of the invention, there is provided a method as defined in the sixteenth aspect comprising:

(a) a process of polishing an object to be polished with an polishing pad comprising at least one layer made of a resin film and having compressibility of 5% or below in a base layer of the polishing pad.

In the eighteenth aspect of the invention, there is provided a method as defined in the sixteenth or seventeenth aspect wherein the process (a) comprises:

(a-1) a process of polishing an object to be polished by a polisher while maintaining surface load of 40 g/cm$^2$ or below to the object to be polished and supplying a polishing medium.

In the nineteenth aspect of the invention, there is provided a method as defined in the eighteenth aspect wherein the process (a) comprises:

(a-2) a process performed subsequent to the process (a-1) of polishing the object to be polished by the polisher while supplying only liquid which does not contain a polishing medium.

In the twentieth aspect of the invention, there is provided a method as defined in the nineteenth aspect wherein surface load to the object to be polished is maintained at 40 g/cm$^2$ or below in the process (a-2).

In the twenty-first aspect of the invention, there is provided a method as defined in any of the sixteenth to twentieth aspects wherein, after the polishing, flatness of the object to be polished is less than 230 nmPV and surface roughness at RMS of the object to be polished is less than 0.20 nm.

In the twenty-second aspect of the invention, there is provided a method as defined in any of the sixteenth to twenty-first aspects comprising:

(b) a process performed prior to the process (a) of polishing the object to be polished to flatness of at least 230 nmPV and surface roughness at RMS of at least 0.4 nm.

In the twenty-third aspect of the invention, there is provided a method as defined in any of the sixteenth to twenty-second aspects wherein the polishing medium used in the process (a) is a cerium oxide polishing medium.

In the twenty-fourth aspect of the invention, there is provided a method as defined in any of the sixteenth to twenty-third aspects wherein an average particle diameter of the polishing medium used in the process (a) is 1.0 μm or below.

In the twenty-fifth aspect of the invention, there is provided a method as defined in any of the sixteenth to twenty-fourth aspects wherein concentration of the polishing medium used in the process (a) is 1.0 wt % or below.

In the twenty-sixth aspect of the invention, there is provided a method as defined in any of the sixteenth to twenty-fifth aspects wherein the substrate is a substrate for a photo mask.

According to the invention, there is provided a substrate having excellent flatness and surface roughness in the high accuracy region, namely flatness of 100 nmPV or below and surface roughness at RMS of 0.17 nm or below and a method for polishing the substrate without providing a special cover layer but by having such surface properties in the substrate per se. It is of course possible to obtain values of flatness and surface roughness higher than the above described values by adjusting polishing time and other conditions. The substrate of the present invention are suitable particularly as substrates for liquid crystal display and electronic devices including semiconductor wafers or information recording medium and, more particularly, substrates for photo mask and more particularly as substrates of photo mask for EVU micro-lithography.

According to the invention, no special process other than a polishing process such as providing a special cover layer is required for realizing flatness and surface roughness in the high accuracy region and, therefore, the substrate of the present invention can be manufactured at a low cost.

DESCRIPTION OF PREFERRED EMBODIMENTS

The substrate of the present invention should preferably have flatness of less than 230 nmPV (peak-to-valley) and surface roughness at RMS of less than 0.20 nm. By realizing these surface property values, the present application can be applied to substrates requiring high accuracy properties. Particularly, for applying the invention to a mask substrate of an exposure device using exposure wavelength of extreme ultraviolet ray, more preferably flatness is 150 nmPV or below and the most preferable flatness is 100 nmPV or below, and more preferable surface roughness at RMS is 0.18 nm or below and the most preferable surface roughness at RMS is 0.17 nm or below. When surface roughness is expressed in Ra, preferable surface roughness Ra is less than 0.18 nm, more preferable Ra is 0.16 nm or below and the most preferable Ra is 0.12 nm or below.

RMS herein is used in the same meaning as Rq, i.e., "root-mean-square roughness". For measuring RMS, an atomic scope microscope is used as a measuring instrument and measurement was made with the scope of measurement of 5 μm×5 μm. Ra herein means "arithmetic mean roughness" and conditions for measuring Ra are the same as those for RMS. PV (peak-to-valley) herein has the same meaning as flatness and represents sum of maximum height of the peak and maximum depth of the valley from the reference plane. For measuring flatness, an interferometer is used as a measuring instrument and measurement was made with the scope of measurement within 5 mm inside of the outer periphery of the substrate.

In case the substrate of the present invention is used for purposes requiring extremely high accuracy, average linear thermal expansion coefficient should preferably be as low as possible. Particularly, in case the substrate is used for a mask substrate of EUV micro-lithography, the substrate of the present invention should have average linear thermal expansion coefficient $\alpha$ should preferably within a range of $0.0\pm0.3\times10^{-7}/°$ C., more preferably $0.0\pm0.2\times10^{-7}/°$ C. and, most preferably $0.0\pm0.1\times10^{-7}/°$ C. within temperature range from 0° C. to 50° C. or within temperature range from 19° C. to 25° C.

For realizing the above described thermal expansion property, the substrate of the present invention should preferably comprise $SiO_2$ and $TiO_2$. Further, an object to be polished comprising these two components facilitates achievement of surface properties which satisfy highly accurate flatness and surface roughness as shown in Examples of the invention by a polishing process to be described later. Mechanism of how such surface properties can be achieved is not known but the inventors of the present invention have derived the concept of the effects of adding these components from their experience. As to amounts of these components, it is preferable that $SiO_2$ should be added, in mass %, in an amount of 50-97% and $TiO_2$ should be added, in mass %, in an amount of 1.5-10%.

Further, from the above described standpoint, it is most preferable that the substrate should comprise, in mass %, 47-65% $SiO_2$, 1-13% $P_2O_5$, 17-29% $Al_2O_3$, 1-8% $Li_2O$, 0.5-5% MgO, 0.5-5.5% ZnO, 1-7% $TiO_2$ and 1-7% $ZrO_2$.

The substrate should preferably be made of glass or glass-ceramics for easily achieving desired surface properties and low thermal expansion property and, most preferably be made of glass-ceramics because glass-ceramics are hardly vulnerable to scratches caused by polishing. Glass-ceramics comprising β-quartz (β-$SiO_2$) and/or β-quartz solid solution (β-$SiO_2$ solid solution) are most preferable since they have low expansion property.

As an object to be polished, extreme low expansion materials such, for example, as CLEARCERAM (Ohara Inc.), Zerodur (Schott AG), Zerodur-M (Schott AG) and ULE (Corning Incorporated) are suitable materials.

The substrate of the present invention may either be of a circular shape or of a polygonal shape (e.g., square or rectangular). In general, in case a plurality of substrates of a polygonal shape such as a square shape are polished simultaneously by, e.g., a double-side polisher, the shape of each of the substrates sometimes becomes asymmetrical or collapses at a corner. Thus, it is generally more difficult in a substrate having a polygonal shape to achieve highly accurate surface properties than in a substrate having a circular shape. According to the polishing method of the present invention, surface properties having highly accurate flatness and surface roughness as shown in Examples can be achieved, even if the substrate has a polygonal shape.

The polishing method of the present invention comprises processes (b), (a), (a-1) and (a-2). The process (b) is performed prior to the process (a). The process (a) includes two processes of the process (a-1) and the process (a-2).

These processes of the polishing method of the present invention and relevant processes will now be described.

Preliminary Process

A preliminary process may be applied before the processes of the invention. For example, an object to be polished may be cut to a desired shape and then may be lapped in the order of primary lapping and secondary lapping by using abrasive grains which become progressively fine. Then, if necessary, processing such as chamfering is made and then polishing is made in the order of primary polishing and secondary polishing, with flatness and surface roughness being caused to approach to desired values. The lapping and polishing processes may be reduced from the above processes or, conversely, more processes may be performed.

Process (b)

In this process, the object to be polished is polished to flatness of at least 230 nmPV and surface roughness of at least 0.4 nm. In this process, surface roughness is caused to approach a desired value and flatness should preferably reach a finally required value. Particularly, for obtaining a mask substrate of EUV micro-lithography, flatness should more preferably be 150 nmPV or below and, most preferably be 100 nmPV or below.

These surface property values can be realized by an MRF polisher using magneto-rheological finishing method (MRF) or a single-side polisher.

The MRF polisher is a polisher which performs finishing by magneto-rheological fine polishing. More specifically, an object to be polished is attached to the upper spindle of a three-axle CNC controlled machine tool and a rotating wheel and the object to be polished are positioned by an NC controller so that they are located within a predetermined distance to each other. An electromagnet is attached under the surface of the wheel and there is generated gradient magnetic-field in which magnetic force becomes maximum in a gap between the object to be polished and the top of the wheel. When a magneto-rheological polishing agent is supplied to this gradient magnetic-field, the polishing agent is attracted onto the surface of the wheel under the influence of the gradient magnetic-field and thereby polishes the object to be polished (cited from the Journal of Abrasive Grain Processing Institute vol. 146, No. 8, 2002 Aug.). The MRF polishing method is described in detail in this journal.

The single-side polisher is a polisher which has a foamed pad attached only to the lower board of an ordinary type of a double-side polisher and polishes an object to be polished with self-weight of the object or outside load being applied to the object to be polished.

It is not easy to achieve final value of surface roughness with such MRF polisher or single-side polisher but, by achieving final value of flatness or a value which is close to the final value of flatness with such polisher, time required for subsequent polishing can be significantly shortened.

Process (a)

In this process, the object to be polished is polished with a polishing pad comprising at least one layer having compressibility of 5% or below in a base layer of the polishing pad.

Compressibility herein means compressibility based on JIS L-1096. More specifically, when thickness measured under condition of load of 60 gf and measuring pressure of 300 g/cm$^2$ with a dial gauge having a tip of 0.20 cm$^2$ is represented by T1 and thickness measured under condition of load of 360 gf and measuring pressure of 1800 g/cm$^2$ is represented by T2, compressibility is represented by the formula $$\text{Compressibility (\%)}=((T1-T2)/T1)\times100.$$

The polishing pad used in this process has at least two layers of a surface layer and a base layer consisting of one or more layers and it is important to have at least one hard layer having compressibility of 5% or below. By making a layer included in the base layer hard in this manner, surface roughness of a desired final value can be realized while maintaining flatness of a desired final value which has already been achieved in the previous process. For enhancing the effect of the hard layer included in the base layer maintaining desired flatness of the object to be polished, this compressibility should more preferably be 0.8% or below and, most preferably be 0.2% or below. As the hard layer included in the base layer, a flexible material in the form of a film made of, e.g., plastics, thermoplastic elastomer, rubber and metal may be used. This material may contain foam but preferably should not contain foam. More specifically, epoxy resin, polyurethane resin, polyethylene terephthalate, polycarbonate and stainless steel may be used among which polyethylene terephthalate is preferable. From the standpoint of maintaining flatness, the surface layer should preferably be a single layer and the base layer should preferably be a single layer, i.e., the base layer should preferably consist of a hard layer only.

The surface layer of the polishing pad used in the process (a) should preferably have a nap structure with a diameter of an opening being within a range from 70 μm to 180 μm. Surface hardness of the surface layer should preferably be less than 80 in hardness A based on JIS K7311, for this hardness can prevent occurrence of scratches on the surface of the object to be polished. The surface layer of urethane material may preferably be used.

Compressibility of the polishing pad as a whole used in the process (a) should preferably be within a range from 4% to 10% and, more preferably, within a range from 5% to 9.5%. Thickness of the polishing pad as a whole should preferably be within a range from 0.3 mm to 0.9 mm and, more preferably, within a range from 0.4 mm to 0.6 mm.

Process (a-1)

This process constitutes one of divided processes of the process (a). In this process, polishing is made by using a polisher having the polishing pad used in the process (a) with surface load on the object to be polished being maintained at 40 g/cm$^2$ or below and with a polishing medium being supplied.

As the polisher, either a single-side polisher or a double-side polisher may be used but a double-side polisher may be preferably used, for, in the double-side polisher, there is no likelihood that while one surface is being polished, the other surface is soiled and time for processing is shorter than a single-side polisher. The revolution number of the polisher should preferably be within a range from 30 revolutions/minute to 50 revolutions/minute, more preferably within a range from 30 revolutions/minute to 40 revolutions/minute and, most preferably, within a range from 40 revolutions/minute to 50 revolutions/minute.

For achieving desired flatness and surface roughness, processing time should preferably be within a range from 5 minutes to 20 minutes, more preferably within a range from 5 minutes to 10 minutes and, most preferably, within a range from 7 minutes to 10 minutes.

A low surface load of the polishing pad on an object to be polished is an important factor for achieving desired surface roughness while maintaining flatness. More specifically, the surface load on the object to be polished should preferably be 40 g/cm$^2$ or below, more preferably be 35 g/cm$^2$ or below and, most preferably, be 28 g/cm$^2$ or below.

There is no particular limitation in the polishing medium to be used and conventional polishing media including colloidal silica and cerium oxide, for example, may be used. Cerium oxide is particularly preferable as the polishing medium because a high polishing speed can be achieved by using this polishing medium. Concentration of a polishing medium should preferably be 1.0 wt % or below for achieving a desired value of surface roughness, more preferably be 0.5 wt % or below and, most preferably be 0.1 wt % or below. For the same reason, average particle diameter of the polishing medium should preferably be 1.0 μm or below, more preferably be 0.5 μm or below and, most preferably be 0.4 μm or below.

Process (a-2)

This process is the other part of the divided process (a) and is performed after the process (a-1). In this process, polishing is made by using a polisher having the polishing pad used in the process (a) with surface load on the object to be polished being maintained at 40 g/cm$^2$ or below and with a liquid containing no polishing medium being supplied. Another process may be inserted between the process (a-1) and the process (a-2) but normally the process (a-1) is completed by stopping supply of the polishing medium in the process (a-1) and the process (a-2) is started successively by starting supply of the liquid containing no polishing medium.

By making polishing by supplying a liquid which does not contain a polishing medium, grains of the polishing medium which have entered fine depressions on the surface of the object to be polished are removed and occurrence of scratches on the surface of the object to be polished can be prevented.

As the liquid which does not contain a polishing medium, a liquid of pH 6 to pH8 is preferable and tap water may be used as a suitable liquid. Pure water and ion exchange water may also be used and a buffer solution may also be used with such water. A case where a very small amount of a polishing medium remaining in the supply path of the liquid is supplied with the liquid is included in the process (a-2).

As the polisher, either a single-side polisher or a double-side polisher may be used but a double-side polisher may be preferably used, for, in the double-side polisher, there is no likelihood that while one surface is being polished, the other surface is soiled and time for processing is shorter than a single-side polisher. The revolution number of the polisher should preferably be within a range from 30 revolutions/minute to 50 revolutions/minute, more preferably within a range from 30 revolutions/minute to 40 revolutions/minute and, most preferably, within a range from 40 revolutions/minute to 50 revolutions/minute.

Processing time should preferably be within 30 minutes, more preferably within 15 minutes and, most preferably, within 10 minutes.

A low surface load of the polishing pad on an object to be polished is an important factor for achieving desired surface roughness while maintaining flatness. More specifically, the surface load on the object to be polished should preferably be 40 g/cm$^2$ or below, more preferably be 35 g/cm$^2$ or below and, most preferably, be 28 g/cm$^2$ or below.

EXAMPLES

Preliminary Process

Extreme low expansion glass-ceramics were cut to substrates of 155 mm×155 mm×7.5 mm and lapped by a double-side lapper. This lapping process was divided into two steps of primary lapping and secondary lapping by changing conditions of lapping such as abrasive grain.

In the primary lapping, a double-side lapper was used with free abrasive grain of #1500 and at revolution number of 20 revolutions/minute. PV of the substrate after the primary lapping was all 3 μm.

The secondary lapping was made by using a lapper which was different from the lapper for the primary lapping with free abrasive grain of #1500 and at a revolution number of 20 revolutions/minute. PV of the substrate after the secondary lapping was 1-2 μm.

Then, the end faces were chamfered and polishing was made by using a double-side polisher. In the polishing also, the polishing process was also divided into two steps of primary polishing and secondary polishing.

Process (b)

The MRF polisher made by QED was used for removing fine distortions and scratches which were not removed by the polishing medium and flatness of 150 nmPV or below and surface roughness of 0.4 nm RMS or below were achieved.

Process (a)

Process (a-1)

Polishing was made by using a double-side polisher with surface load on the object to be polished being maintained at 40 g/cm$^2$ or below and supplying a polishing medium. As the polishing pad, a polishing pad having a base layer consisting of a single layer made of PET film having compressibility of 0.1% and having a surface layer consisting of a single layer of a nap structure was used. As the polishing medium, cerium oxide was used.

Process (a-2)

After the process (a-1), supply of the polishing medium was stopped and polishing using only tap water was started with surface load being maintained at 40 g/cm$^2$. As the polishing pad, the pad which was used in the process (a-1) was used.

Tables 1 and 2 show examples of the present invention with respect to conditions of the respective processes and surface property values measured after completion of these processes.

TABLE 1

| | Example | 1 | 2 | 3 |
|---|---|---|---|---|
| Material | $SiO_2$ (wt %) | 55.0 | 55.0 | 55.0 |
| | $TiO_2$ (wt %) | 2.5 | 2.5 | 2.5 |
| | $P_2O_5$ (wt %) | 8.0 | 8.0 | 8.0 |
| | $Al_2O_3$ (wt %) | 24.0 | 24.0 | 24.0 |
| | $Li_2O$ (wt %) | 4.0 | 4.0 | 4.0 |
| | MgO (wt %) | 0.8 | 1.0 | 1.0 |
| | ZnO (wt %) | 0.5 | 0.5 | 0.5 |
| | CaO (wt %) | 1.2 | 1.0 | 1.0 |
| | BaO (wt %) | 1.0 | 1.0 | 1.0 |
| | $ZrO_2$ (wt %) | 2.0 | 2.0 | 2.0 |
| | $As_2O_3$ (wt %) | 1.0 | 1.0 | 1.0 |
| Predominant crystal phase | | β-quartz/ β-quartz solid solution | β-quartz/ β-quartz solid solution | β-quartz/ β-quartz solid solution |
| | α (0-50° C.) | $0.1 \times 10^{-7}$ | $0.2 \times 10^{-7}$ | $-0.1 \times 10^{-7}$ |
| | α (19-25° C.) | $0.1 \times 10^{-7}$ | $0.2 \times 10^{-7}$ | $-0.1 \times 10^{-7}$ |
| Primary polishing | | | | |
| polishing medium | | cerium oxide | cerium oxide | cerium oxide |
| rev./min. | | 50 | 50 | 50 |
| polishing pad | | MHC15A (Rodel) | MHC15A (Rodel) | MHC15A (Rodel) |
| After primary polishing | | | | |
| PV | | 500 nm | 500 nm | 500 nm |
| RMS | | 0.8 nm | 0.8 nm | 0.8 nm |
| Secondary polishing | | | | |

TABLE 1-continued

| Example | 1 | 2 | 3 |
|---|---|---|---|
| polishing medium | cerium oxide | cerium oxide | cerium oxide |
| rev./min. | 40 | 50 | 40 |
| polishing pad | N0030 (Kanebo) | SPM3100 (Rodel) | N0020 (Kanebo) |
| After secondary polishing | | | |
| PV | 500 nm | 500 nm | 500 nm |
| RMS | 0.3 nm | 0.3 nm | 0.3 nm |
| After process (b) | | | |
| PV | 100 nm | 100 nm | 100 nm |
| RMS | 0.35 nm | 0.35 nm | 0.35 nm |
| Process (a) | | | |
| Process (a - 1) | | | |
| polishing medium | cerium oxide | cerium oxide | cerium oxide |
| concentration | 0.3 wt % | 0.1 wt % | 0.2 wt % |
| polishing pad | N0030 (Kanebo) | SPM3100 (Rodel) | N0020 (Kanebo) |
| rev./min. | 50 | 50 | 50 |
| surface load | 40 g/cm$^2$ | 40 g/cm$^2$ | 40 g/cm$^2$ |
| polishing time | 10 min. | 10 min. | 10 min. |
| Process (a - 2) | | | |
| liquid | tap water | tap water | tap water |
| polishing pad | N0030 (Kanebo) | SPM3100 (Rodel) | N0020 (Kanebo) |
| rev./min. | 40 | 50 | 40 |
| surface load | 40 g/cm$^2$ | 40 g/cm$^2$ | 40 g/cm$^2$ |
| polishing time | 15 min. | 10 min. | 15 min. |
| After process (a) | | | |
| PV | 220 nm | 100 nm | 210 nm |
| RMS | 0.22 nm | 0.17 nm | 0.21 nm |
| Ra | 0.18 nm | 0.14 nm | 0.17 nm |

TABLE 2

| | Example | 4 | 5 |
|---|---|---|---|
| Material | $SiO_2$ (wt %) | 55.5 | 55.5 |
| | $TiO_2$ (wt %) | 2.3 | 2.3 |
| | $P_2O_5$ (wt %) | 7.5 | 7.6 |
| | $Al_2O_3$ (wt %) | 24.5 | 24.4 |
| | $Li_2O$ (wt %) | 3.95 | 3.97 |
| | MgO (wt %) | 1.0 | 1.0 |
| | ZnO (wt %) | 0.5 | 0.5 |
| | CaO (wt %) | 1.05 | 1.03 |
| | BaO (wt %) | 1.0 | 1.0 |
| | $ZrO_2$ (wt %) | 2.0 | 2.0 |
| | $As_2O_3$ (wt %) | 0.7 | 0.7 |
| Predominant Crystal phase | | β-quartz/ β-quartz solid solution | β-quartz/ β-quartz solid solution |
| | α (0-50° C.) | $0.1 \times 10^{-7}$ | $0.1 \times 10^{-7}$ |
| | α (19-25° C.) | $0.1 \times 10^{-7}$ | $0.1 \times 10^{-7}$ |
| Primary polishing | | | |
| polishing medium | | cerium oxide | cerium oxide |
| rev./min. | | 50 | 50 |
| polishing pad | | MHC15A (Rodel) | MHC15A (Rodel) |
| After primary polishing | | | |
| PV | | 500 nm | 500 nm |
| RMS | | 0.8 nm | 0.8 nm |
| Secondary polishing | | | |
| polishing medium | | cerium oxide | cerium oxide |

TABLE 2-continued

| Example | 4 | 5 |
|---|---|---|
| rev./min. | 40 | 40 |
| polishing pad | SPM3100 (Rodel) | N0020 (Kanebo) |
| After secondary polishing | | |
| PV | 500 nm | 500 nm |
| RMS | 0.3 nm | 0.3 nm |
| After process (b) | | |
| PV | 100 nm | 100 nm |
| RMS | 0.35 nm | 0.35 nm |
| Process (a) | | |
| Process (a - 1) | | |
| polishing medium | cerium oxide | cerium oxide |
| concentration | 0.1 wt % | 0.5 wt % |
| polishing pad | SPM3100 (Rodel) | N0020 (Kanebo) |
| rev./min. | 50 | 50 |
| surface load | 40 g/cm$^2$ | 40 g/cm$^2$ |
| polishing time | 10 min. | 10 min. |
| Process (a - 2) | | |
| liquid | tap water | tap water |
| polishing pad | SPM3100 (Rodel) | Apollon-p (Rodel) |
| rev./min. | 40 | 40 |
| surface load | 40 g/cm$^2$ | 40 g/cm$^2$ |
| polishing time | 15 min. | 15 min. |
| After process (a) | | |
| PV | 100 nm | 210 nm |
| RMS | 0.17 nm | 0.19 nm |
| Ra | 0.14 nm | 0.15 nm |

INDUSTRIAL APPLICABILITY

According to the present invention, there are provided substrates having excellent flatness and surface roughness in the high accuracy region, particularly substrates for liquid crystal display and electronic devices including semiconductor wafers or information recording medium and, more particularly, masks and mirrors and substrates for such masks and mirrors for EVU micro-lithography, as well as a method for polishing such substrates.

What is claimed is:

1. A method for polishing a substrate comprising:

(a) a process of polishing an object to be polished with a polishing pad consisting of a surface layer and a base layer, said surface layer and base layer respectively consisting of a single layer and said base layer having compressibility based on JIS L-1096 of 0.8% or below and compressibility of said polishing pad as a whole being within a range from 4% to 10% and thickness of said polishing pad as a whole being within a range from 0.3 mm to 0.9 mm.

2. A method as defined in claim 1 wherein, after the polishing, flatness of the object to be polished is less than 230 nmPV and surface roughness at RMS of the object to be polished is less than 0.20 nm.

3. A method as defined in claim 1 comprising:

(b) a process performed prior to the process (a) of polishing the object to be polished to flatness of at least 230 nmPV and surface roughness at RMS of at least 0.4 nm.

4. A method as defined in claim 1 wherein the polishing medium used in the process (a) is a cerium oxide polishing media.

5. A method as defined in claim 1 wherein an average particle diameter of the polishing medium used in the process (a) is 1.0 μm or below.

6. A method as defined in claim 1 wherein concentration of the polishing medium used in the process (a) is 1.0 wt % or below.

7. A method as defined in claim 1 wherein the substrate is a substrate for a photo mask.

8. A method as defined in claim 1 wherein the process (a) comprises:

(a-1) a process of polishing an object to be polished by a polisher while maintaining surface load of 40g/cm$^2$ or below to the object to be polished and supplying a polishing medium.

9. A method as defined in claim 8 wherein the process (a) comprises:

(a-2) a process performed subsequent to the process (a-1) of polishing the object to be polished by the polisher while supplying only liquid which does not contain a polishing medium.

10. A method as defined in claim 9 wherein surface load to the object to be polished is maintained at 40g/cm$^2$ or below in the process (a-2).

11. A method as defined in claim 1 comprising:

(a) a process of polishing an object to be polished with a polishing pad consisting of a surface layer and a base layer, said surface layer and base layer respectively consisting of a single layer and said base layer being made of a resin film and having compressibility based on JIS L-1096 of 0.8% or below, and compressibility of said polishing pad as a whole being within a range from 4% to 10% and thickness of said polishing pad as a whole being within a range from 0.3 mm to 0.9 mm.

12. A method as defined in claim 11 wherein the process (a) comprises:

(a-1) a process of polishing an object to be polished by a polisher while maintaining surface load of 40g/cm$^2$ or below to the object to be polished and supplying a polishing medium.

* * * * *